United States Patent [19]

Salvucci et al.

[11] 4,450,039

[45] May 22, 1984

[54] WEB SPLICING APPARATUS

[75] Inventors: Orfeo J. Salvucci, Holbrook; John M. Hobby, Sherborn; James J. Hennessy, Woburn, all of Mass.; Ronald R. Young, Pawtucket, R.I.

[73] Assignee: Harris Graphics Corporation, Westerly, R.I.

[21] Appl. No.: 410,508

[22] Filed: Aug. 23, 1982

[51] Int. Cl.[3] ..... B65H 19/08; B65H 19/22; B32B 31/00; B26F 3/02

[52] U.S. Cl. ..... 156/504; 156/507; 156/510; 156/511; 156/159; 225/36; 225/89; 242/58.5

[58] Field of Search ..... 156/502, 504, 505, 506, 156/507, 510, 511, 159, 494, 495; 242/58.5; 225/89, 67, 68, 70, 72, 36

[56] References Cited

U.S. PATENT DOCUMENTS

| | | | |
|---|---|---|---|
| 2,320,092 | 5/1943 | Miller | 156/495 |
| 3,627,616 | 12/1971 | Davis | 156/355 |
| 4,108,391 | 8/1978 | Martinez | 156/505 |
| 4,190,475 | 2/1980 | Marschke | 156/504 |
| 4,279,370 | 7/1981 | Lash | 225/67 |

*Primary Examiner*—Edward C. Kimlin
*Assistant Examiner*—Merrell Cashion
*Attorney, Agent, or Firm*—Wolf, Greenfield & Sacks

[57] ABSTRACT

A splicing head for an automatic zero-speed web splicing machine is disclosed in which the end of a new roll of web material can be prepared for splicing directly on resilient nip rollers which are used by the machine to perform the splicing operation. In particular, the splicing head includes a knife carriage through which the web material passes and which can be moved transversely to the web travel direction under control of a cam and lever arrangement to introduce a predetermined loop of slack into the web material.

The action of the cam and lever mechanism also positions a serrated preparation blade mounted on cantilever arms in front of the nip rollers for squarely trimming the edge of the web material. After the web material has been trimmed the preparation blade can be moved by the cam and lever arrangement to an out-of-the-way position to allow preparation of the web material and to prevent interference with the splicing machine as the web material runs through the machine after the splice has been made.

26 Claims, 17 Drawing Figures

272
254
226
250
252
253
251
273
201
225
229
228
263
256
255
240
244
242
245
243
241
259
248
3
3
205
206
257
258
210
220
215
224
227
246
222
233
202
203
200
4
4
10
10
5
5
290
271
230
234
236
235
247
231
232
270
260

305
355
361
364
360
362
363
357
323
321
320
322
325
340
341
342
343
327
347
345
346
344
348
359
345
375
358
356
306

WEB SPLICING APPARATUS

FIELD OF THE INVENTION

This invention relates to web splicing apparatus and, more particularly, to zero-speed web splicing apparatus.

BACKGROUND OF THE INVENTION

Many manufacturing machines, such as printing presses, cigarette-making machines and bag-making machines, utilize a continuous ribbon or band or web of raw material to manufacture a stream of finished product. Such machines utilize a variety of materials, including paper, cardboard and thin metal foil. Often this web material is provided to the manufacturing machine from a large, continuous roll of material which may comprise several thousand feet of web material. In operation, the utilization machinery draws the web material from the supply roll at a high rate of speed which may approach several hundred feet per minute.

Often, the web material follows a tortuous path through such machines and a considerable amount of time must be spent in initially setting up the machine prior to operation to ensure the web material is under proper tensions and follows the correct path through the machine. Consequently, it is advantageous to provide a continuous supply of web material to the machine to avoid having to stop the machine at the end of each roll of web material and rethread the mechanism as each roll of web material becomes exhausted.

Accordingly, various splicing mechanisms have been devised to splice the leading edge of a new roll of web material (called the "ready roll") to the trailing edge of an expiring roll of material (called the "running roll") while the utilization machine is operating to provide a continuous strip of web material to the utilization machine.

Several different types of splicing machines have been developed to automatically perform such a splicing operation. In these machines, a splice is usually made by adhering the leading edge of the ready roll to a portion of the running roll of web material by means of cement or double-faced, pressure-sensitive tape and then severing the web from the running roll behind the splice.

In order to form a reliable splice, the web material in the ready and running rolls must be moving at approximately the same speed. Conventional splicing machines accomplish speed matching in two different ways. "On-the-fly" splicers utilize an electric motor or other driving means to accelerate the ready roll so that its web material is travelling at the same speed as the web material is being drawn from the running roll. The splicing operation is actually performed "on-the-fly" as the two webs are moving through the splicing apparatus.

In "zero-speed" splicers, the running roll of web material is braked nearly to a stop and the splicing operation is performed while the webs from both the ready roll and the running roll are substantially stopped. Since, as previously mentioned, it is usually not desirable to stop the utilization machine during the splicing operation, a web "accumulator" or "festooner" is provided between the utilization machine and the splicing apparatus. The accumulator consists of a bank of fixed rollers and a bank of opposing, movable rollers and the web material is wound between the rollers in a festoon fashion to provide a large slack loop. During the splicing operation when the web material has been substantially stopped, the roller banks move together to provide the necessary web material to keep the manufacturing machine in operation. After the splice is completed, the ready roll of material is accelerated to its running speed and a feedback mechanism controls the web accumulator to return the movable rollers to their normal position.

In a typical zero-speed splicer, the two webs are pressed together to form a splice by a pair of resilient "nip rollers". Prior to a splicing operation, the leading edge of the ready roll must be prepared for splicing and placed on one of the nip rollers. The nip rollers are provided with a row of holes and are connected to a vacuum source applied to the nip roller and thus the web material adheres to the roller and is held in position until the splice is made.

Preparation of the leading edge of the ready roll involves trimming the web edge squarely and applying cement of a strip of gummed tape to adhere the edge to the other web. Typically, on prior art machines such preparation is done on such a "vacuum bar" mounted in front of the nip rollers. The first step in splice preparation is to release a braking mechanism on the ready roll and draw the web material over the vacuum bar. At this point vacuum is applied to the vacuum bar holding the web material in place. A knife or razor is then used to trim leading edge of the web material squarely and then cement or splicing tape is applied to the edge. The vacuum is then removed, the prepared edge is transferred from the vacuum bar to the one of the nip rollers and vacuum then is reapplied, causing the web material to adhere to the nip roller. Finally, the nip roller and the prepared edge is rotated into splicing position, usually directly opposite the other nip roller.

At this point, the operator preparing the splicing machine must manually rotate the ready roll of web material and reapply the brake, thereby removing any slack in the web to prevent breakage of the web when the splicing operation is subsequently performed.

The splicing machine is then ready to automatically splice the ready roll to the running roll. In order to do this, the splicing machine monitors the diameter of the running roll and, when a predetermined diameter is reached the splicing mechanism brakes the expiring roll of material to a stop, automatically brings the nip rollers together causing the leading edge of the ready roll to adhere to a portion of the running roll, and operates an automatic knife to sever the running roll behind the splice. Depending on the proximity of the knife to the nip rollers, a trailing flap of material known as a "trailer" is left at the splice location. However, in most utilization machines, the trailer does not cause a significant problem. At the end of the splicing operation, the nip rollers automatically separate and an acceleration motor accelerates the ready roll to running speed.

One of the problems with the prior method of preparing the leading edge of the ready roll for splicing is that it is difficult to properly trim the leading edge of the web material in order to produce a square cut. If the edge of the web material is not severed at a precise right angle to the material, the resulting splice is not straight causing uneven tension and allowing the web material to run off its guiding rollers, in turn, causing a breakage of the web material and the consequent interruption of the of the manufacturing process.

In addition, with prior art devices, since the web material must be removed from the vacuum bar and transferred to the nip rollers, it was often possible to apply the web material to the nip roller in a slanted position even though the edge was cut squarely also resulting in web breakage.

In order to overcome these problems some prior art splicing machines allow preparation of the leading edge of the ready roll while it is mounted on the nip rollers. In these machines, during web preparation, the web is drawn over the nip roller and placed on the vacuum bar which is located in front of the nip rollers. System vacuum is then turned on causing the web to adhere to the vacuum bar. The web material can then be trimmed with a razor using the edge of the vacuum bar as a guide. However, since the vacuum bar is located in front of the nip rollers it is possible to cut into the resilient nip rollers in the process of trimming the web, thereby damaging the splicing machine.

In addition, most prior art splicing machines expose the operator to the web severing knife which is operated by the automatic splicing machine during a splicing operation. As this knife is extremely sharp these machines present a safety hazard.

Futher, in most prior art machines, adjustment of the prepared web of material to remove slack often required considerable skill in operating the vacuum and brake controls in order to provide correct tension on the web material. It was also possible during a tensioning operation to pull the web off the nip roller thereby requiring the operator to redo the whole splice preparation resulting in wasted time and effort.

It is therefore an object of the present invention to allow preparation of the leading edge of the ready roll directly on the nip rollers.

It is another object of the present invention to provide as web splice preparation mechanism which automatically introduces the correct amount of slack and tension in the web material during splice preparation.

It is a further object of the present invention to provide a web splice preparation mechanism which is simple to operate and easy to maintain.

It is yet a further object of the present invention to provide a splice preparation mechanism which does not expose the operator's hand or fingers to the web severing knife.

Still a further object of the present invention is to provide a web splice preparation mechainsm which automatically positions a trimming blade in front of the nip rollers so that the edge of the web material may be torn off while the material is adhering to a nip roller.

SUMMARY OF THE INVENTION

The foregoing objects are achieved and the foregoing problems are solved in one illustrative embodiment of the invention in which the web material may be completely prepared while it is adhering to a nip roller. Specifically, after the web material has been drawn over the nip roller the splice preparation mechanism positions a trimming blade in front of the nip roller. The web material may then be torn off against the trimming blade to squarely trim the edge of the material. In the process of positioning the trimming blade to trim the web material edge, the splice preparation mechanism also introduces a slack loop of predetermined length in the web. Therefore, when the nip roller is later rotated into splicing position the web material will be correctly tensioned.

More specifically, during splice preparation, a cam and lever mechanism operates a pair of cantilevered arms, on which the edge trimming blade is mounted, to position the trimming blade in front of the nip rollers for trimming the web material. Also, the web severing knife mechanism is mounted on a moveable carriage. A slot is provided in the carriage through which the web material runs and, during splice preparation, the cam and lever mechanism moves the knife carriage and slot in a direction transverse to the web material thereby introducing a slack loop of predetermined length into the web material. After preparation is complete, the cam and lever mechanism moves the trimming blade out of the way and returns the knife carriage position to its normal position. The nip roller and the prepared web edge may then be rotated into splicing position introducing the proper amount of tension into the roll of web material.

DETAILED DESCRIPTION OF THE PREFERRED EMBODIMENT

Figure 1:
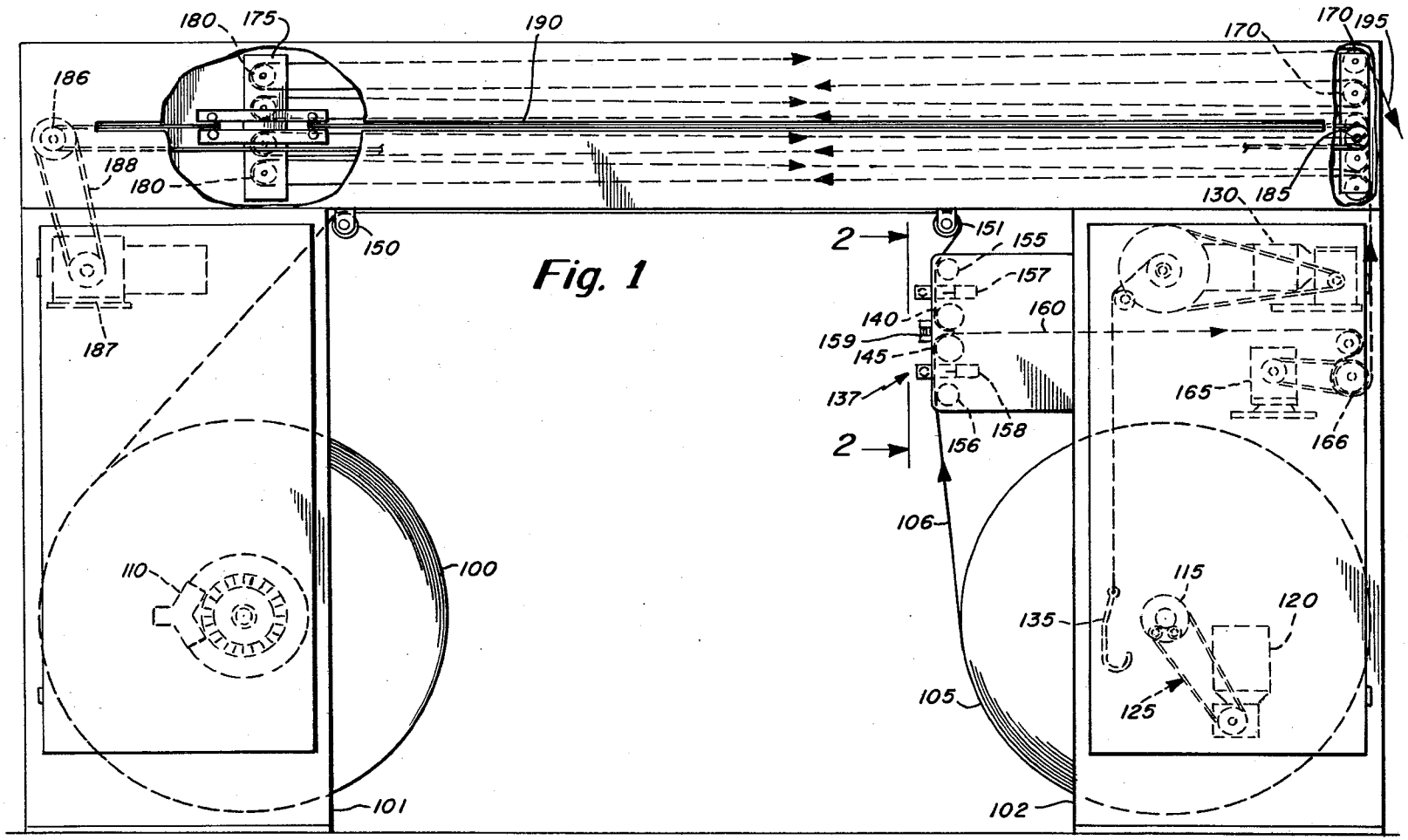
FIG. 1 of the drawing shows a schematic diagram of web splicing apparatus suitable for use with the present invention.

FIG. 1 of the drawing shows a conventional automatic zero-speed splicing machine in which a splicing head 137 containing the inventive splice preparation mechanism is used to prepare the leading edge of the ready roll. The splicing machine shown in FIG. 1 is a horizontal splicing machine in which the rolls of web material are located side-by-side. However, the invention is also useful with a vertical splicing machine in which the rolls of web material are located vertically one above the other.

In particular, two rolls of web material 100 and 105 are shown. Each roll may comprise several thousand feet of web material and may weigh up to several thousand pounds. The rolls of web material are mounted on heavy shafts which sit in journals (not shown) located in side frames 101 and 102. Web roll 105 may be lifted into place by means of a hoist and hook mechanism 130 and 135. A similar mechanism (not shown) is used to lift roll 100 into place.

The shaft of each roll of web material is coupled to a brake mechanism of which only one mechanism, 110, is shown schematically in the Figure. Brake mechanism 110 may be a disc brake mechanism as shown or may, in turn, be a drum brake mechanism or friction clutch assembly. The brake assembly may be electrically or alternatively pneumatically operated all in accordance with well-known operation. In addition, each roll of web material is coupled to a sidelay adjustment motor, such as motor 120. Motor 120 is coupled by means of drive belt 125 to a worm gear mechanism 115 connected to the shaft of roll 105. The sidelay mechanism is used to center roll 105 in a well-known manner prior to performing a splicing operation. Well-known feedback arrangements also control brake mechanism 110 in order to maintain a constant tension in the web material as it is fed through the splicing machine into the utilization device (not shown).

As shown in the Figure, roll 105 is the running roll. In operation, web material 106 passes over idler roller 156 and nip roller 145 after which the web material 160 is drawn over an accelerator mechanism consisting of motor 165 and accelerator roll 166 up into the web accumulator mechanism located above rolls 100 and 105. The accelerator mechanism is used to accelerate the web material to its running speed after a splice has been made.

The web accumulator mechanism consists of a plurality of stationary idler rolls 170. Located opposite the stationary rolls are a plurality of rollers 180 contained on a moveable carriage 175. Carriage 175 moves on track 190 horizontally and the position of carriage 175 is controlled by an endless loop of chain which passes around pulleys 185 and 186. Pulley 186 is, in turn, driven by chain 188 which is controlled by motor 187. Motor 187 contains a well-known magnetic clutch arrangement and is controlled by feedback circuitry to maintain a constant tension between the web material which is festooned between rollers 170 and 180 as shown. The web material exits from the splicing apparatus at location 195.

Roll 100 is the ready roll which is to be prepared for splicing. In particular, web material from roll 100 passes over idler rollers 150 and 151 into the illustrative splicing head 137. Splicing head 137 includes two idler rollers 155 and 156 and two nip rollers 140 and 145. Idler roller 155 and nip roller 140 are used to service web roll 100 and idler roller 156 and nip roller 145 are used to service web roll 105.

Idler rollers 155 and 156 are fixed in position and used to guide the web material into the nip roller area. Nip rollers 140 and 145 are each mounted on a moveable arm and are controlled by conventional splicing circuitry to press together and seal the leading edge of the ready roll to the trailing edge of the running roll during an automatic splicing operation.

In accordance with the present invention, splicing head 137 also includes movable web severing knife carriages 157 and 158 and movable trimming blade 159. Advantageously, as will hereinafter be explained, knife carriages 157 and 158 are moved during a splice preparation operation to insert a predetermined amount of slack in the web material so that nip rollers 140 and 145 may be rotated to the splicing position correctly tensioning the web material prior to the beginning of a splicing operation.

In addition, in accordance with the invention, trimming blade 159 can also be moved during splice preparation into a position in front of either of nip rollers 140 and 145 to allow the edge of the web material to be torn off as the material is held in position on the nip rollers by the system vacuum.

Figure 2:
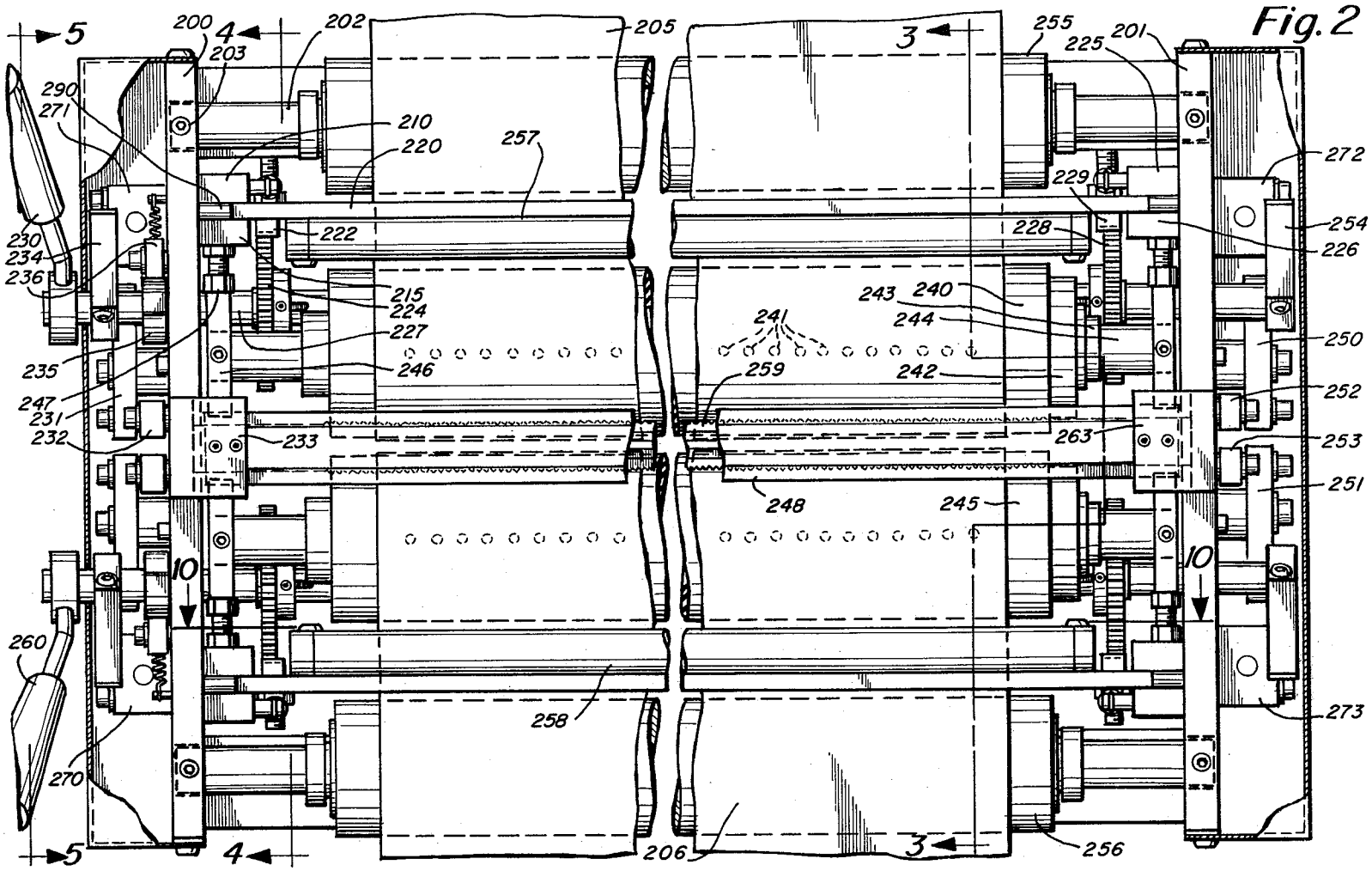
FIG. 2 of the drawing shows a plan view of the illustrative splice preparation mechanism including the cam and lever mechanism and nip rollers taken in the direction of section lines 2—2 of FIG. 1.

FIG. 2 of the drawing shows a front view of illustrative splicer head 137. The splicer head consists of two side frame members 200 and 201 mounted in a position parallel to each other, which frame members hold the various components of the splicer head in relative position. Side members 200 and 201 are bolted to the main frame of the splicing apparatus by four mounting blocks 270–273.

The splicer head consists of an upper half and lower half which are identical in mechanical component arrangement and function. Accordingly, only one half (the upper half) will be discussed in detail to avoid unnecessary repetition. As previously described, each half of the illustrative splicing apparatus is used to prepare the leading edge of one of the rolls of web material. In particular, the upper half of the the illustrative splice preparation apparatus will be described in preparing the leading edge of roll 100.

Specifically, during splice preparation, web material 205 is drawn over idler roller 255 into the splicing head. Roller 255 is, in turn, mounted on shaft 202 and contains internal bearings so that it rotates freely on shaft 202. Shaft 202 is inserted in frames 200 and 201 and secured by means of set screws, such as set screw 203.

Web material 205 is also drawn through knife carriage 257. Knife carriage 257 contains a web severing knife (not shown in FIG. 2) which can be automatically actuated during a splicing operation to sever the trailing end of the running roll. In the case where the leading edge of a new roll of material is being prepared, however, the knife is not used. However, as will be hereinafter explained in detail, knife carriage 257 performs a useful function in automatically providing a loop of slack in web material 205 to later allow nip roller 240 to be rotated in position for splicing.

In particular, knife carriage 257 is mounted on backing plate 220. Plate 220 is, in turn, held in position by two tracks composed of rails 210, 215 and 225, 226 which are mounted to frame members 200 and 201, respectively. The tracks allow backing plate 220 and knife carriage 257 to move in a direction transverse in the direction to movement of web material 205 (into and out of the paper).

Knife carriage 257 can be moved during a splice preparation operation under the influence of pinion gears 224 and 228 which engage rack members 222 and 229, respectively. Gears 224 and 228 are, in turn, mounted on shaft 227 which passes through bearing and frame members 200 and 201 and is connected to handle 230.

Carriage 257 is normally held in a rest position against roll pin 290 by a spring (not shown in FIG. 2). During a splice preparation operation, however, handle 230 may be rotated, in turn, rotating pinion gears 224 and 228 and retracting knife carriage 257 back into the plane of the paper thereby forming a slack loop in web material 205. Handle 230 is connected to a locking collar 235 mounted on shaft 227 which interacts with spring-loaded locking latch 236 to hold carriage 257 in its retracted position while the edge of the web material 205 is being prepared. After the preparation is finished, handle 230 may be rotated to its initial position moving carriage 257 forward and leaving the appropriate slack loop in the web material.

After passing through knife carriage 257, web material 205 passes over nip roller 240. As with idler roller 255, nip roller 240 is mounted on shaft 244 and contains internal bearings allowing it to freely rotate around shaft 244. Shaft 244 is mounted in movable arms, such as arm 246 which can be positioned by a pneumatic cylinder (not shown) to apply pressure to the splice area. During splice preparation arm 246 rests against stop 247.

Nip roller 240 is also covered with a resilient coating which allows it to apply pressure to the splice area during the splicing operation. In addition, nip roller 240 is hollow and is connected by conventional vacuum header 243 to a source of vacuum (not shown). When vacuum is applied to header 243, web material 205 is drawn against nip roller 240 by means of a row of vacuum holes, 241, and held in position during the splice preparation and the actual splice operation.

Advantageously, nip roller 240 is further provided with detent ring 242 which allows, as will be hereinafter described in accordance with the invention, nip roller 240 to be positioned precisely in position for preparing the end of web material 205 and to be later rotated in precise position for performing the splicing operation.

After passing over nip roller 240, web material 205 passes behind trimming blade 259. Trimming blade 259 is shown in its normal rest position which it assumes after web preparation has been completed and while the system is running. Trimming blade 259 is a hardened steel blade with a sharpened serration on both its upper and lower edges. In its rest position, blade 259 is located behind and completely covered by blade guard 248 which prevents injury from the sharp edges of blade 259.

Blade 259 and guard 248 are connected to carriers 233 and 263 which are, in turn, connected to cantilever arms 232 and 252. During splice preparation, blade 259 and guard 248 may be moved into trimming position in front of either nip roller 240 or nip roller 245 under the action of a cam and lever arrangement which is activated by handles 230 and 260.

In particular, the operation of handle 230 in an upward manner (which also causes knife carriage 257 to retract) moves cam 234 which interacts with a follower (not shown in FIG. 2) on linkage 231 causing it to move downward, as will be hereinafter explained. The downward motion of linkage 231, in turn, causes arm 232 to lift carrier 233 upwards to position blade 259 and guard 248 in front of nip roller 240. A similar cam 254 actuates link 250 and arm 252 at the opposite side of the splicing head from handle 230 to ensure that blade 259 maintains a position perpendicular to the travel of web material 205.

As will hereinafter be explained in detail, the operation of link 231 and 250 and arms 232 and 252 cause blade 259 to be shifted out from under guard 248 when it is in its trimming position to allow the leading end of web 205 to be squarely torn off.

After the end of web material 205 has been trimmed on blade 259, handle 230 is rotated downwards causing knife carriage 257 to move forward leaving a slack loop and blade 259 to move to its rest position so that a gummed tape or cement can be applied to the edge of web material 205 in preparation for the splicing operation. After the gummed material has been applied, nip roller 240 can then be rotated to its splicing position and precisely located by means of detent ring 242.

Handle 260 cooperates with similar linkage to move blade 259 over nip roller 245 in order to prepare web material 206 for a splicing operation. In addition, handle 260 also actuates knife carriage 258 in the manner as previously described with knife carriage 257.

Figure 3:
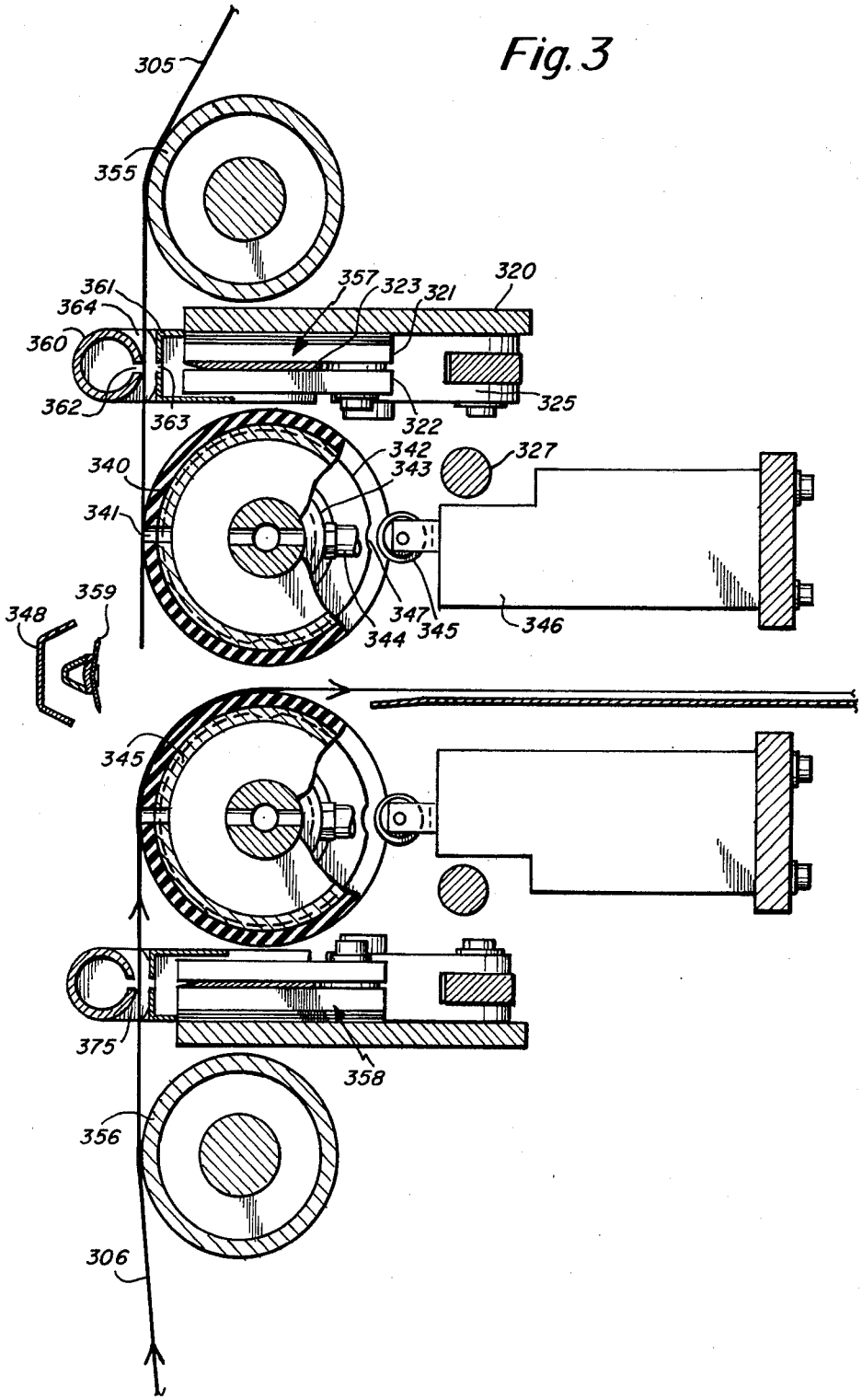
FIG. 3 of the drawing is an end sectional view of the illustrative splice preparation mechanism taken through the section lines 3—3 in FIG. 2 showing the moveable knife carriages, nip rollers and moveable trimming blade.

FIG. 3 shows details of the knife carriages and detent rings for the nip rollers. In particular, web 305, which is to be prepared for splicing, passes over idler roller 355 through slot 364 in knife carriage 357 and in front of nip roller 340. Similarly, the running web 306 passes over idler roller 356 through slot 375 in knife carriage 358 and over nip roller 345 to the remainder of the splicing machine.

As previously described, nip roller 340 is hollow and connected to a source of vacuum via line 344 and vacuum header 343. When web material 305 is in the position shown in FIG. 3, it is drawn against nip roller 340 by vacuum applied to the web material through holes 341. Nip roller 340, in turn, can be held in position by means of a detent ring 342 which is engaged by detent roller 345 attached to pneumatic cylinder 346.

Specifically, the application of compressed air to cylinder 346 extends detent roller 345 which bears against detent ring 342. Roller 345 fits into detent 347 and locks nip roller 340 into position for splice preparation. A similar detent (not shown) is used to position nip roller in proper position for automatic splicing. After the splice has been completed, the vacuum and the compressed air are automatically turned off by the system releasing the web material from the nip roller and deenergizing cylinder 346. An internal spring in the cylinder then retracts detent roller 345, allowing nip roller 340 to rotate freely.

Also shown in detail is knife carriage 357. Carriage 357, as previously described, is bolted to backing plate 320 and includes blade guides 321 and 322 which are bolted to backing plate 320. Guides 321 and 322 provide a slot in which severing knife blade 323 may travel in a horizontal direction.

Blade 323, as will hereinafter be described in detail, is actuated by a pivot link 325 which pivots about a post attached to backing plate 320. When knife blade 323 is in its retracted position, a guard 361 prevents access by the operator to prevent injury. When knife blade 323 is actuated by a mechanism which will be described later it moves out of guard 361 via slot 363, severs web 305 and moves into guard 360, via slot 362. At no time is the knife blade ever exposed to the operator's fingers.

In accordance with the invention, guard 360 is circular so that when knife carriage 357 moves into its splice preparation position (to the right as shown in FIG. 3), guard 360 will introduce a slack loop of predetermined length in web material 305 to allow nip roller 340 to be rotated to its splicing position.

Also shown in FIG. 3 is trimming blade 359 and its guard 348 which are shown in their rest positions.

Figure 4:
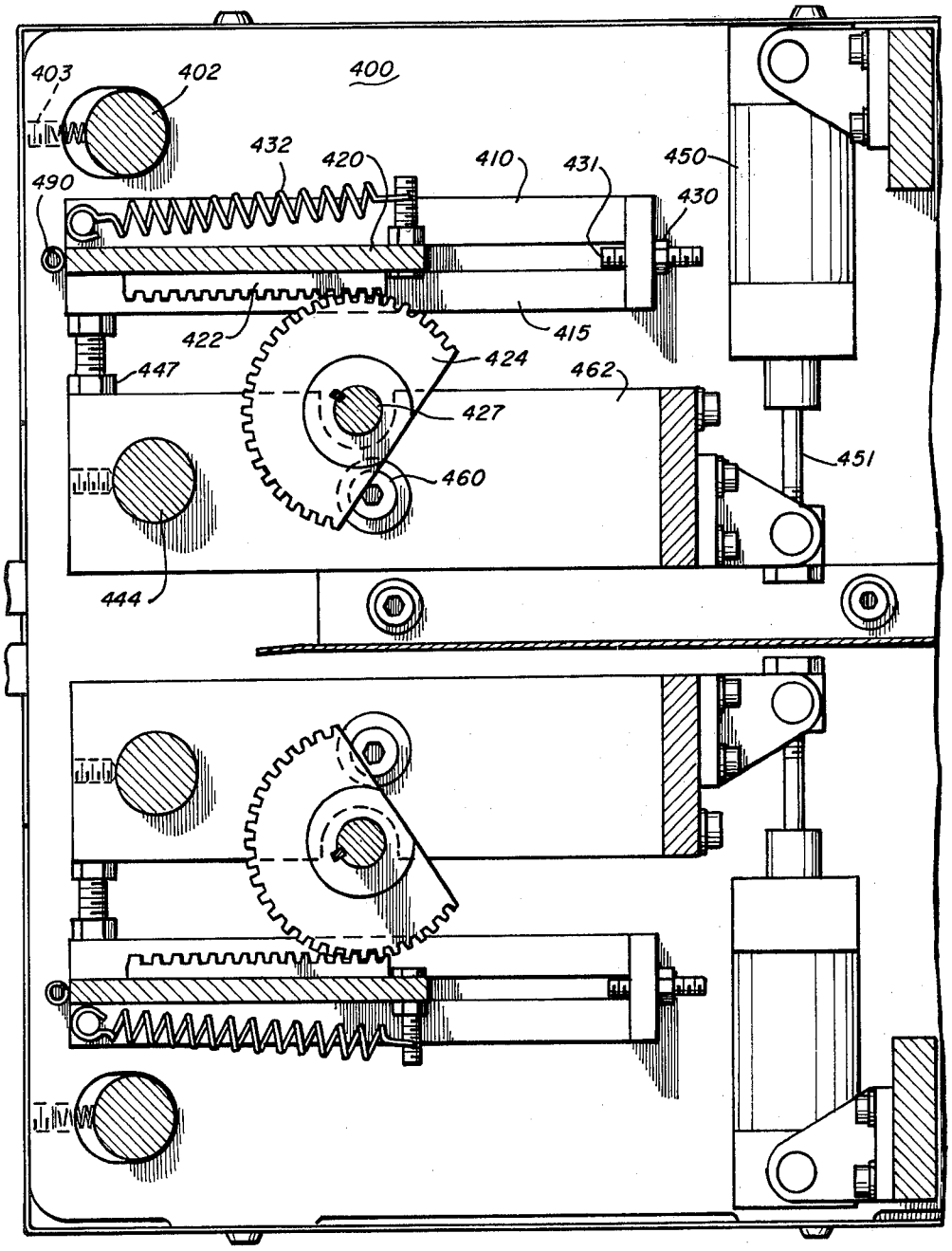
FIG. 4 is a sectional view through the illustrative splice mechanism through section lines 4—4 in FIG. 2 and shows the mechanical mechanism operating the nip rollers and the rack and pinion gear arrangement for positioning the moveable knife carriages.

FIG. 4 shows a detailed view of the rack and pinion gears which operate the moveable knife carriages. The idler and nip rollers have been left out in order to expose the carriage mechanism. As previously mentioned, track members 410 and 415 form an elongated track in which backing plate 420 of the knife carriage slides in a horizontal direction.

Backing plate 420 is normally held against roll pin 490 by means of spring 432 which bears against a post mounted on plate 420 and a post mounted on track member 410. Under control of pinion gear 424, however, plate 420 and the associated knife carriage may be drawn toward the right in FIG. 4 a predetermined distance until stop 431 is contacted.

In particular, gear 424 is keyed onto shaft 427 which is connected to the splice preparation handles and may be rotated during the splice preparation operation causing gear 424 to rotate in a clockwise direction which by engaging rack member 420 moves the knife carriage to the right.

Advantageously, in accordance with the invention, the travel of the knife carriage and therefore the amount of slack introduced into the web material may be accurately set by adjusting stop 431. In particular, nut 430 may be loosened and 431 (which is threaded) may be adjusted so that the proper tension is achieved after splice preparation is complete.

This ability to accurately adjust the amount of slack introduced into the web during splice preparation is particularly useful in certain splicing operations. Normally during a splicing operation, the nip roller on which the leading edge of the ready roll has been prepared is moved to complete the splice against the other nip roller. However, in certain situations it is desirable to move either the upper nip roller, the lower nip roller or both rollers during a splicing operation. On most prior art machines it was not possible to easily perform a splicing operation in which the lower nip roller or both rollers moved. This problem occurred because different roller movement required different amounts of slack to be left in the web during splice preparation and there was no prior art method to accurately adjust the amount of slack.

More particularly, the upper nip roller which rotates on shaft 444 is mounted on moveable arm 462 which pivots around bolt 460 in response to the movement of piston 451 in pneumatic cylinder 450. During a normal splicing operation, compressed air is applied to cylinder 450 causing piston 451 to retract and rotate arm 462 around pivot 460. The nip roller is thereby moved into contact with the moving web to establish the splice and slack must be left to accomodate this movement. Alternatively, if the lower nip roller moves less slack is needed in the web.

Figure 5:
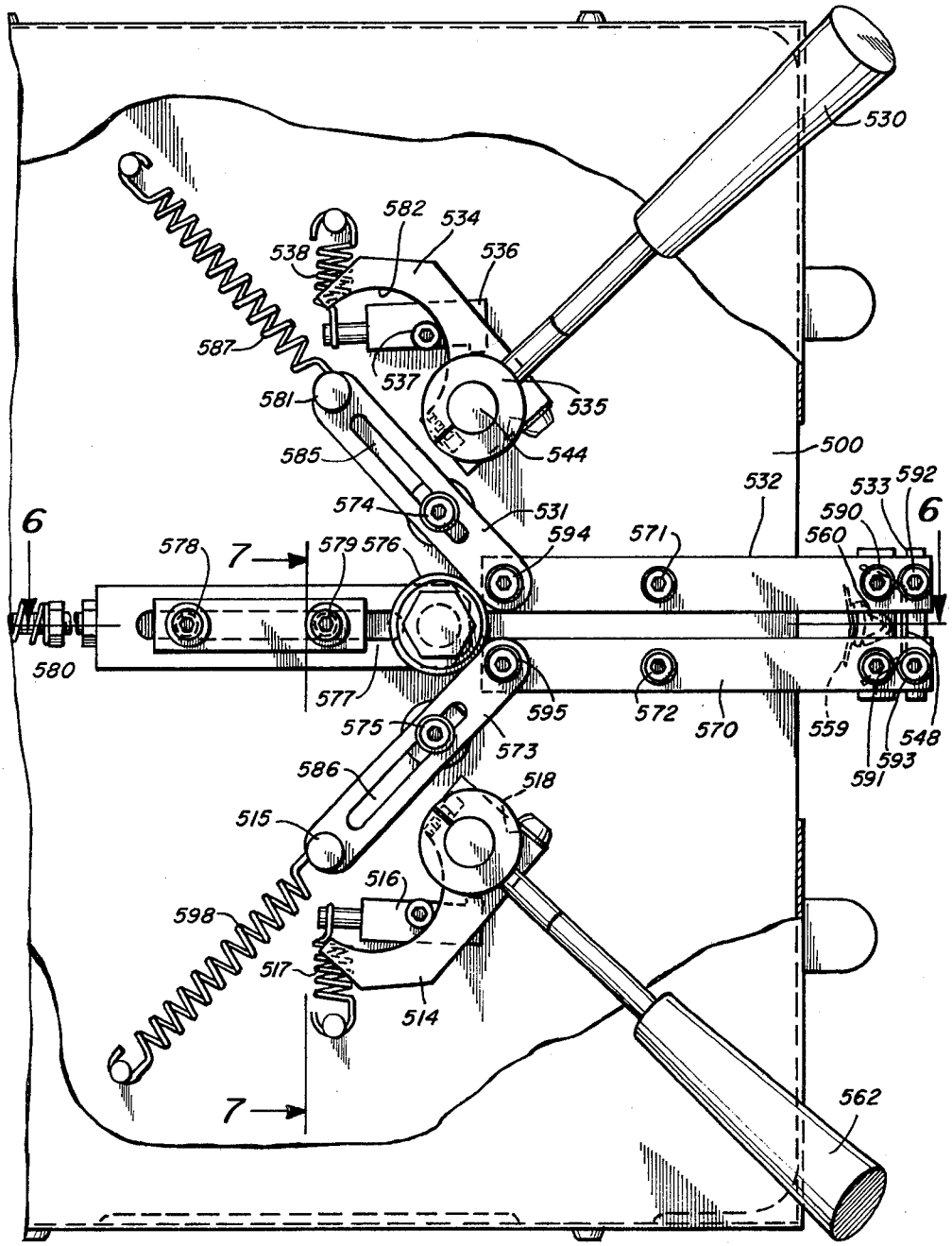
FIG. 5 of the drawing is an end sectional view of the illustrative splicing apparatus in the direction of section lines 5—5 in FIG. 2 showing the cam and lever mechanism for positioning the trimming blade.

FIG. 5 shows an illustrative mechanical configuration of the cam and lever arrangement which operates the trimming blade and the movable knife carriages. As with the previously described portions of the splicing head, the cam and lever arrangement has identical parts which can be used to position the trimming blade to prepare web material on either the upper or lower nip rollers. In particular, handle 530 is used to actuate the mechanism to prepare web material on the upper nip roller and handle 560 is used to actuate the mechanism to prepare material on the lower nip roller. The mechanical arrangement of the parts is shown in the rest condition.

Handle 530 is connected to cam 534 which has a semi-circular camming surface 582. Handle 530 and cam 534 are, in turn, connected to shaft 544 by means of a split ring arrangement which is tightened by a screw. As previously explained, shaft 544 is connected to the pinion gear and rack arrangement which operates the movable knife carriage. Also attached to shaft 544 is a locking collar 535 which cooperates with locking latch 536 to latch the handle mechanism in the splice preparation position. Locking latch 536 pivots around stud 537 and is held against locking collar 535 by means of spring 538.

Roller 581 acts as a cam follower against camming surface 582. Roller 581 is, in turn, attached to link member 531 which contains a slot, 585, therein through which a pin, 574, projects. Pin 574 is fastened to frame 500 and constrains the movement of link member 531. Link 531 is pivotally attached at point 594 to cantilever arm 532 which, in turn, is pivotally attached to frame 500 via pivot stud 571.

Identical linkage is provided on the lower half of the splice preparation apparatus. In particular cam 514 acts on roller 515 which actuates link 573. Link 573, in turn, contains a slot 586 which rides over pin 575 attached to frame 500. Link 573 is also pivotally attached at point 595 to cantilever arm 570 which is itself pivotally attached to frame 500 by means of stud 572.

The outward ends of cantilever arms 532 and 570 are connected to carriers which support trimming blade, 559, and its guard, 548. In particular, blade guard 558 is attached to carrier 533 which is, in turn, pivotally attached to both cantilever arms 532 and 570 at pivot points 592 and 593. Trimming blade 559 is attached to carrier 560 which is pivotally attached to points 590 and 591 on arms 532 and 570, respectively.

Links 531, 573 and arms 532, 570 are held in their respective rest positions by springs 587 and 598. An additional centering roller, 576, also helps to keep the mechanism centered in its rest position. In particular, roller 576 is connected to slotted link 577 which is reciprocally mounted on pins 578 and 579 attached to frame member 500. A spring 580 forces link 577 and centering roller 576 to bear against links 531 and 573 helping to center the mechanism.

As will be hereinafter described, when either of handles 530 or 560 is actuated, links 531, 573 and arms 532, 570 are actuated to position trimming blade 559 in front of either the upper or lower nip rollers in order to trim the edge of the web material during splice preparation.

Figure 6:
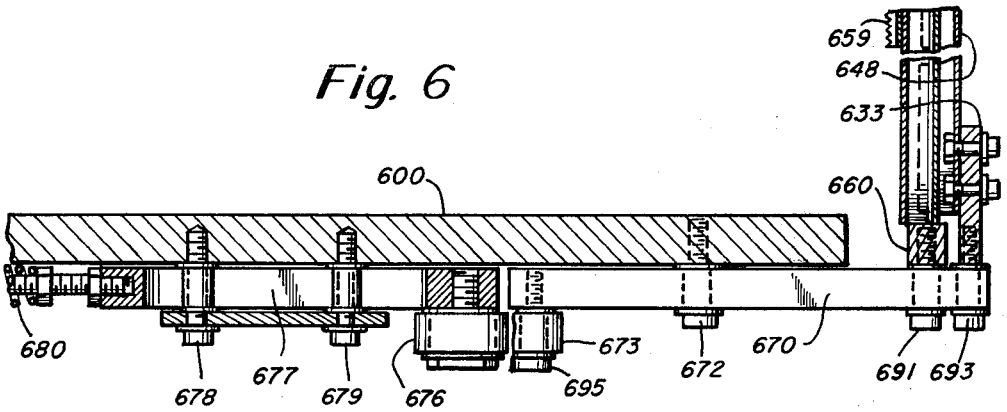
FIG. 6 is a sectional view taken through section lines 6—6 in FIG. 5 showing the cam and lever mechanism of the illustrative splicing arrangement.
Figure 7:
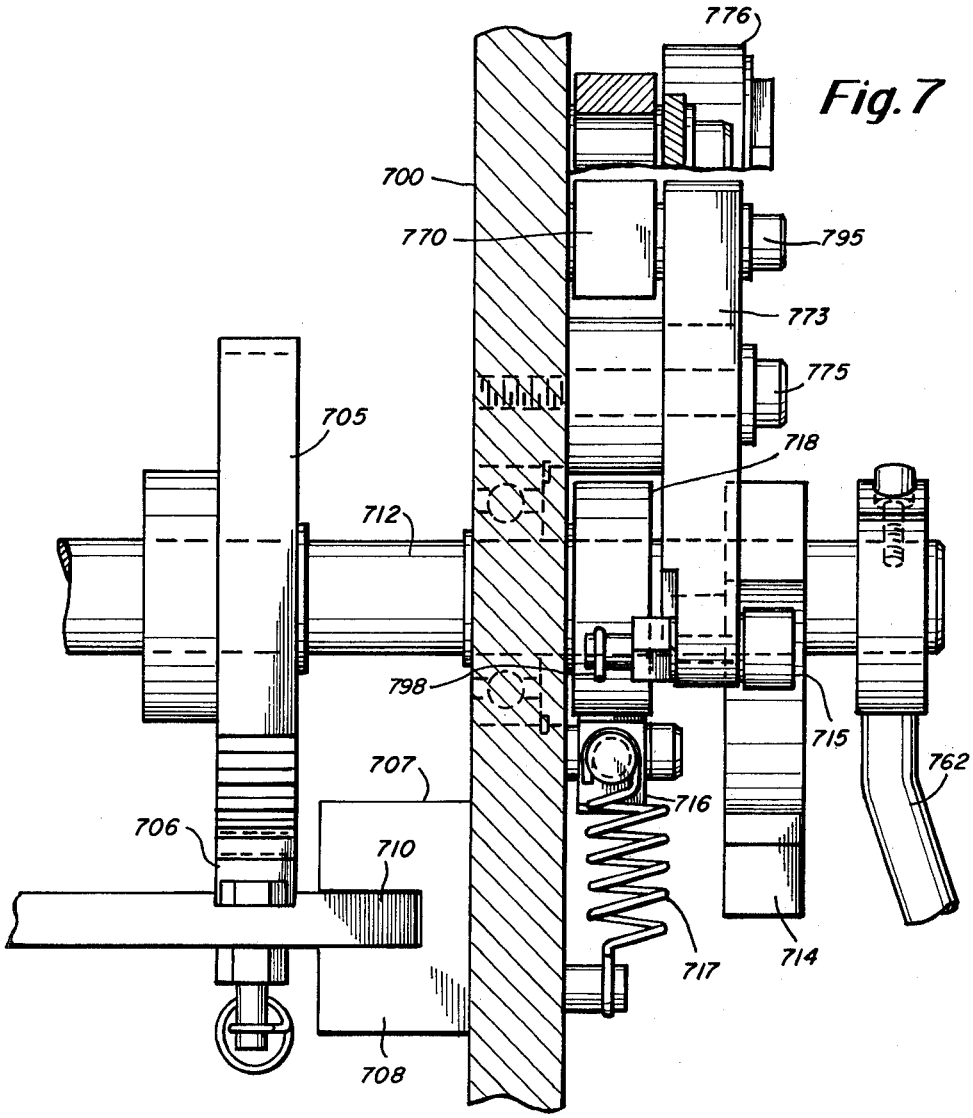
FIG. 7 is a sectional view of the illustrative splicing mechanism taken through section lines 7—7 of FIG. 5 showing the arrangement of the cams, levers and rack and pinion gears for the moveable knife carriage.

FIGS. 6 and 7 show additional sectional views of the cam and link mechanism with the components marked with corresponding numbers as those shown in FIG. 5. FIG. 6, in particular, shows the attachment of centering link 677 and its associated centering roller 676 to the frame 600 and the attachment of the blade and guard carriers, 633 and 660 to cantilever arm 632.

FIG. 7, in turn, shows additional details of the cam follower roller 715 and the attachment of the centering spring to arm 773. FIG. 7 also shows the connection of pinion gear 705 to shaft 712 which is rotated by handle 760 during splice preparation and the interaction between pinion gear 705 and rack member 706 which moves knife carriage 710 in tracks 707 and 708.

Figure 8:
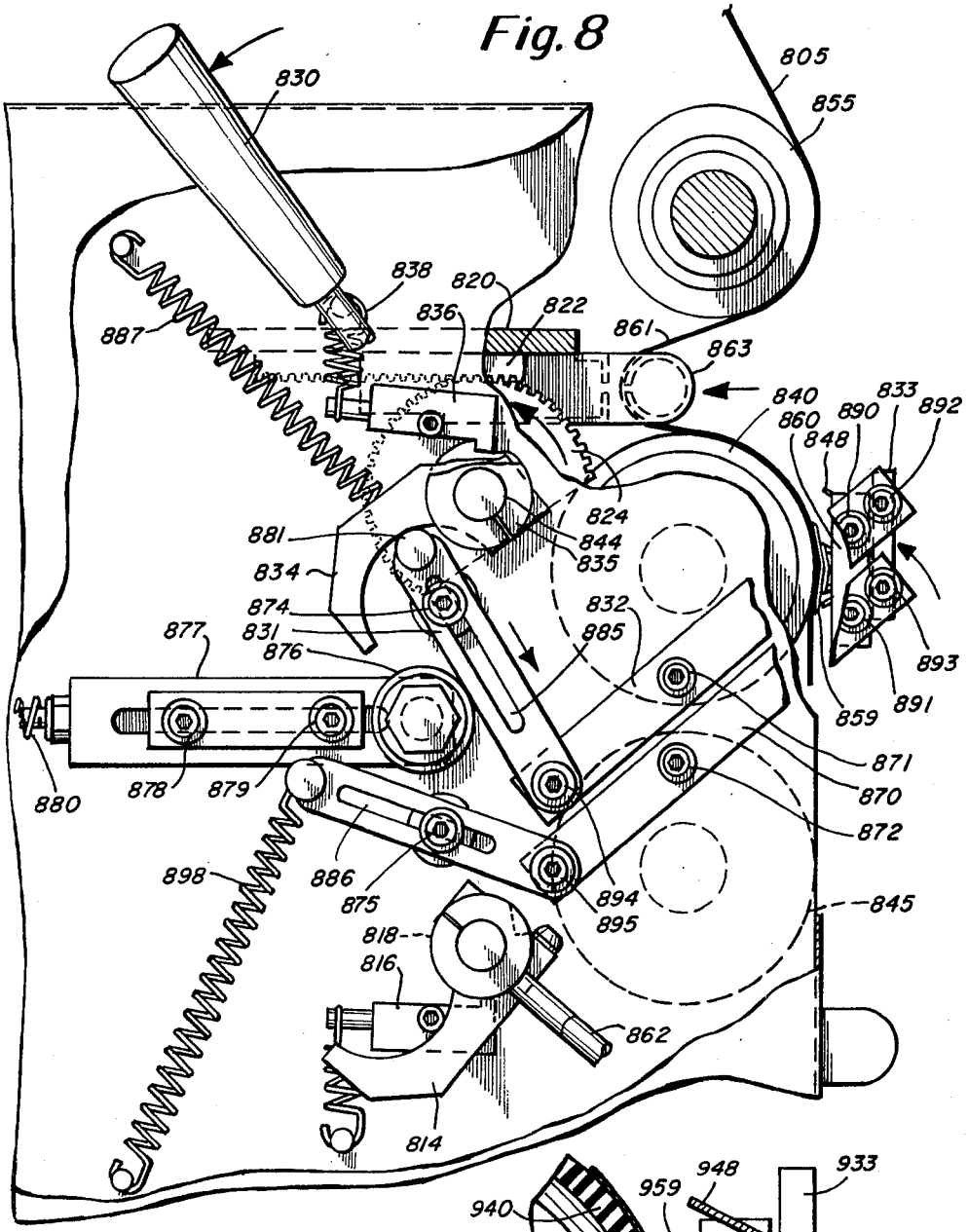
FIG. 8 shows the cam and lever mechanism rotated into position for preparing the leading end of the ready roll of web material on the upper nip roller.

FIG. 8 shows the operation of the cam and link mechanism when the upper handle is rotated to position the trimming blade for preparing web material on the upper nip roller. In particular, when handle 830 is rotated in a counterclockwise direction pinion gear 824 meshes with rack 822 to draw upper knife carriage 857 inwards causing blade guard 863 to form a loop 861 in web 805 between idler roller 855 and nip roller 840.

Simultaneously, cam 834 bears against roller 881 sliding link 831 over post 874 which, in turn, causes cantilever arm 832 to pivot around stud 871. The action of link 831 and arm 832 causes the trimming blade and its guard to swing up into preparation position in front of upper nip roller 840.

Figure 9:
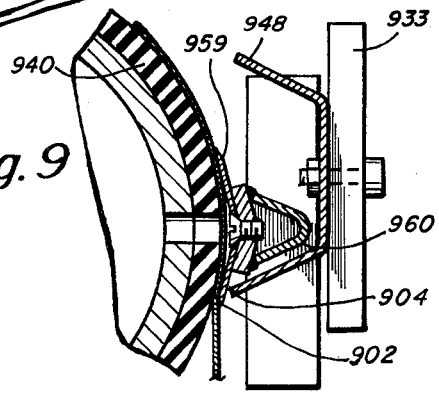
FIG. 9 of the drawing is a detail of the splice preparation blade shown in preparation for tearing off the end of the ready roll.

Since the pivot points of guard carrier 833 and blade carrier 860 are slightly offset, blade carrier 833 shifts upward a slightly greater distance than blade carrier 860. Therefore, when the blade and guard have reached their final positions, blade 859 emerges from under guard 848. The position of the blade and guard in the preparation position are shown in detail in FIG. 9. As shown in FIG. 9, edge 902 protrudes past the edge of guard 904, allowing the web material to lifted up and ripped off across blade edge 902. FIG. 9 also shows that trimming blade 909 is slightly bent in order to force the web material closer to the face of nip roller 940.

The operation of link 831 and arm 832 also causes centering roller 876 and its supporting link 877 to slide along posts 878 and 879 compressing spring 880.

Handle 830 is locked in its preparation position by means of locking collar 835 and spring-loaded locking latch 836. After the web material has been trimmed against trimming blade 959, handle 830 can be returned to its normal rest position by applying sufficient force to force spring-loaded locking latch 836 out of the detent in locking collar 835. When handle 830 returns to its original position, trimming blade is lowered to its resting position between nip rollers 840 and 845 and the knife carriage returns to its initial position leaving a free loop of web material 805.

Similarly, handle 862 may also be actuated to lower the preparation blade to its splice preparation position in front of nip roller 845.

Figures 10, 11:
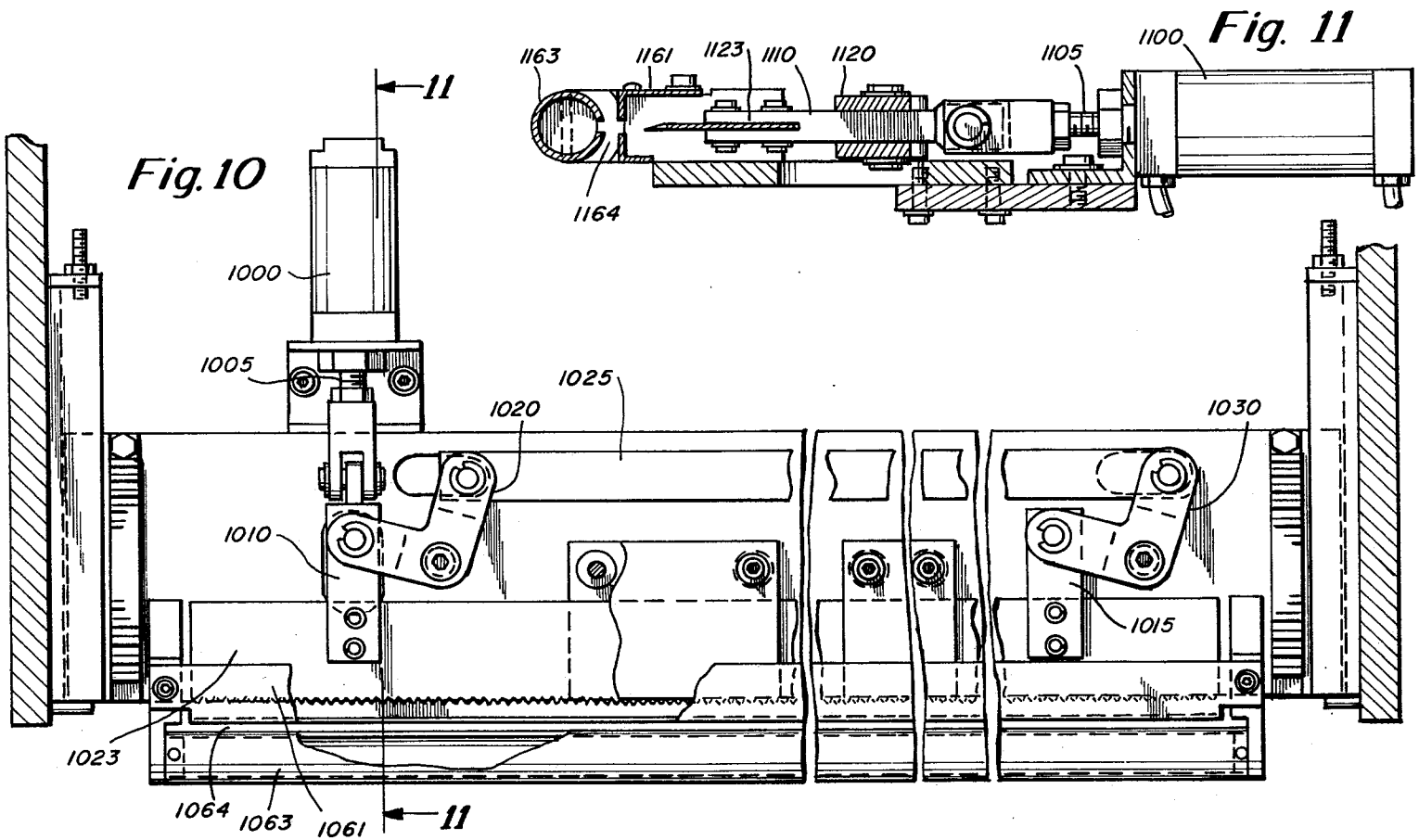
FIG. 10 of the drawing is a detail showing the operating linkage of the web severing knife.
FIG. 11 of the drawing is a sectional view of the web severing knife carriage taken in the direction of section lines 11—11 in FIG. 10.
Figure 12:
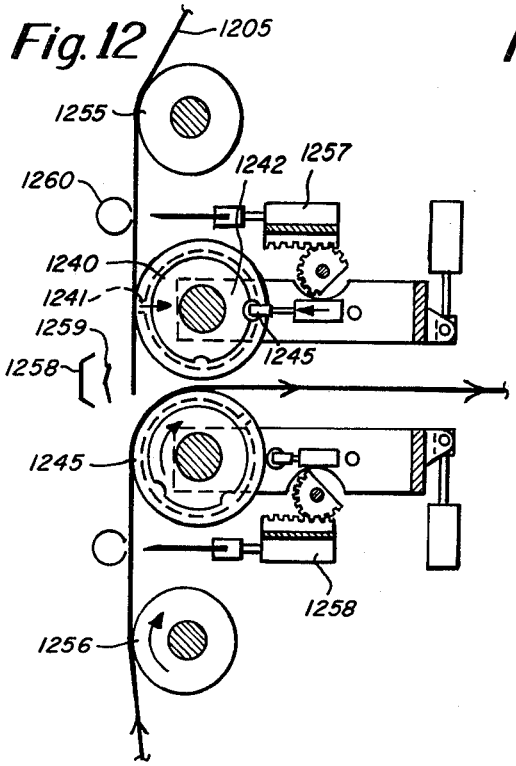
FIGS. 12–17 of the drawing schematically illustrate the action of the illustrative apparatus in various stages of splice preparation from beginning until after the splice has been completed.

FIGS. 10 and 11 show additional mechanical details of the web severing knife carriage. In particular, the knife mechanism is controlled by pneumatic cylinder 1000. The knife is automatically actuated by the splicing mechanism in accordance with well-known principles, by providing compressed air to cylinder 1000 thus forcing piston 1005 downward. The motion of piston 1005 is imparted to knife carrier 1010 causing the left edge of the knife 1023 to move through a slot in knife guard 1061 across the web slot 1064 an into knife guard 1063. The motion of plunger 1005 is also transmitted to draw bar 1025 by pivot link 1020. Draw bar 1025 is pulled to the left in FIG. 10, which motion, in turn, causes pivot link 1030 to apply a downward force to blade carrier 1015. This force moves the right-hand edge of knife 1023. Knife 1023 is arranged so that it strikes the web material at a slight angle causing a shearing rather than cutting action to ensure a clean cut.

FIG. 11 is a sectional view of the knife carriage and pneumatic actuator arrangement showing additional details of the pivot link connections.

FIGS. 12 through 17 show various stages of splice preparation using the illustrative splice preparation apparatus. In particular in FIG. 12, the leading edge of the ready roll of web material is being prepared on upper nip roller 1240. To begin splice preparation, the braking mechanism on the ready roll is released and web material 1205 is drawn over idler roller 1255, through the web slot in knife carriage 1257 and across nip roller 1240. Nip roller 1240 is then rotated to engage the detent on ring 1242 with roller 1245 to lock nip roller 1240 in the splice preparation position (after a splice operation has taken place the splice mechanism applies compressed air to cause detent roller 1245 to extent and bear against detent ring 1242). The brake mechanism is then reactivated to lock the ready roll in position.

Figure 13:
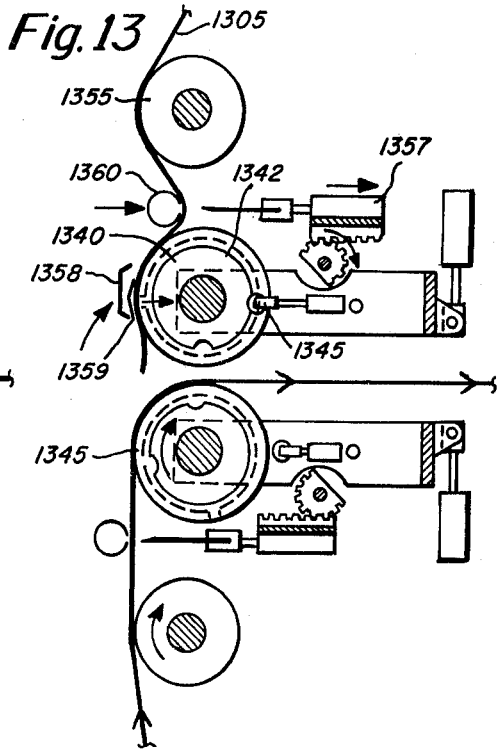

The next stage of splice preparation is shown in FIG. 13, in which the upper splicing handle is rotated, as previously described, in order to retract knife carriage 1357 and raise trimming blade 1359 and its associated guard 1358 into their splice preparation position in front of nip roller 1340. The movement of knife carriage 1357 causes knife guard 1360 to introduce a loop of material into web 1305 in accordance with the predetermined travel of knife carriage 1357. The system vacuum is then turned on causing web 1205 to adhere to roller 1240 by means of vacuum holes 1241. The edge of web material 1305 is then trimmed by tearing it off against the exposed edge of trimming blade 1359.

Figure 14:
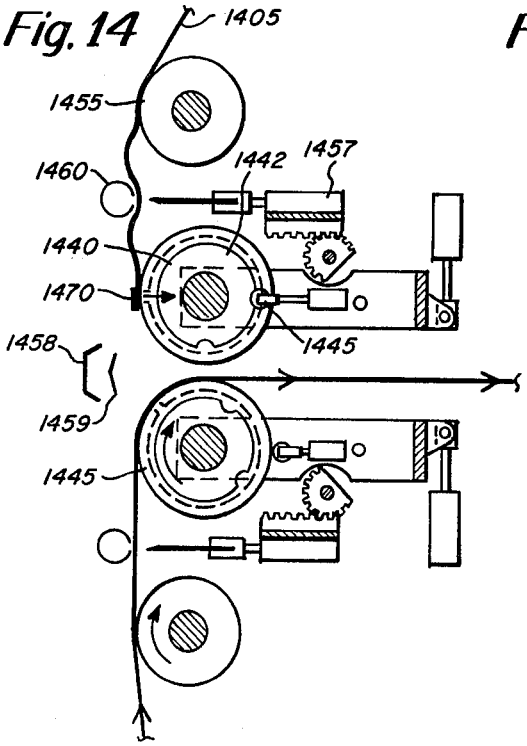
Figure 15:
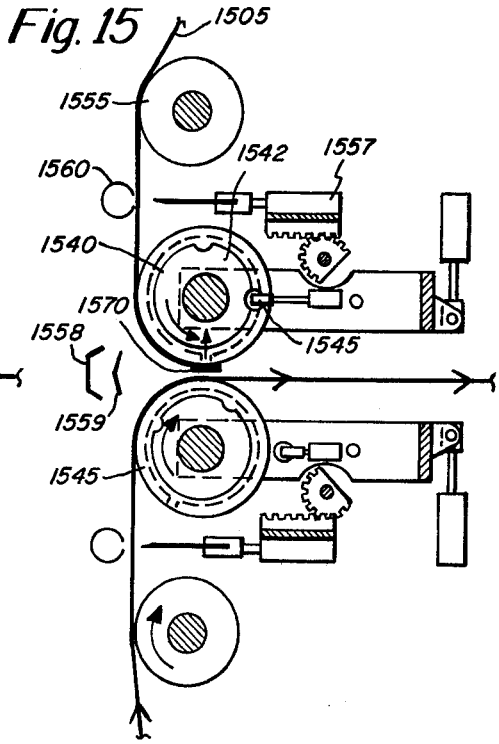

Next, as shown in FIG. 14, the splice preparation handle is rotated back to its initial position, causing knife carriage 1457 to return to its initial position, in turn, leaving a slack loop in the web material 1405. The action of the splicing handle also returns trimming blade 1459 and its associated guard 1458 to their rest positions. At this time a piece of splicing tape or cement can be applied to the leading edge of web 1405 which still adheres to nip roller 1440 due to the vacuum in the system.

The next step (shown in FIG. 15) is the rotation of nip roller 1540 into splicing position. This rotation is possible due to the action of detent roller 1545 and detent ring 1542. When nip roller 1540 has been rotated into splicing position a second detent engages roller 1545 indexing the roller in the proper position. As previously described, the loop introduced into web material 1505 by the action of knife carriage 1557 is exactly the correct length in order to introduce proper tension in the web material when nip roller 1540 is rotated into splicing position. The system is now ready for the automatic splicing operation to take place.

Figure 16:
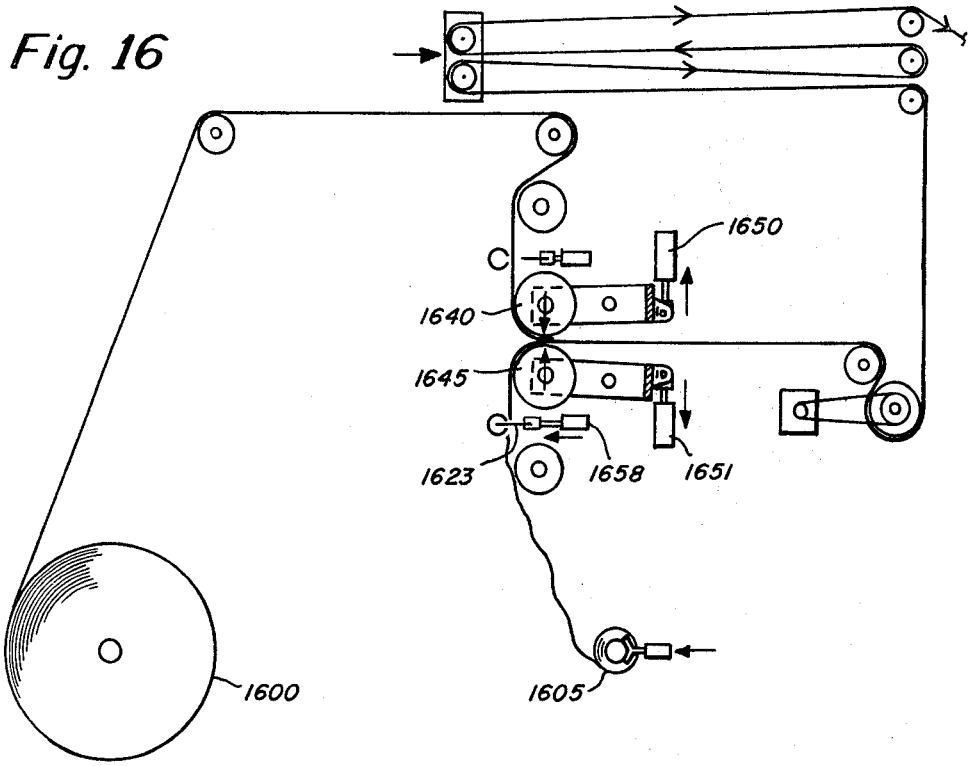
Figure 17:
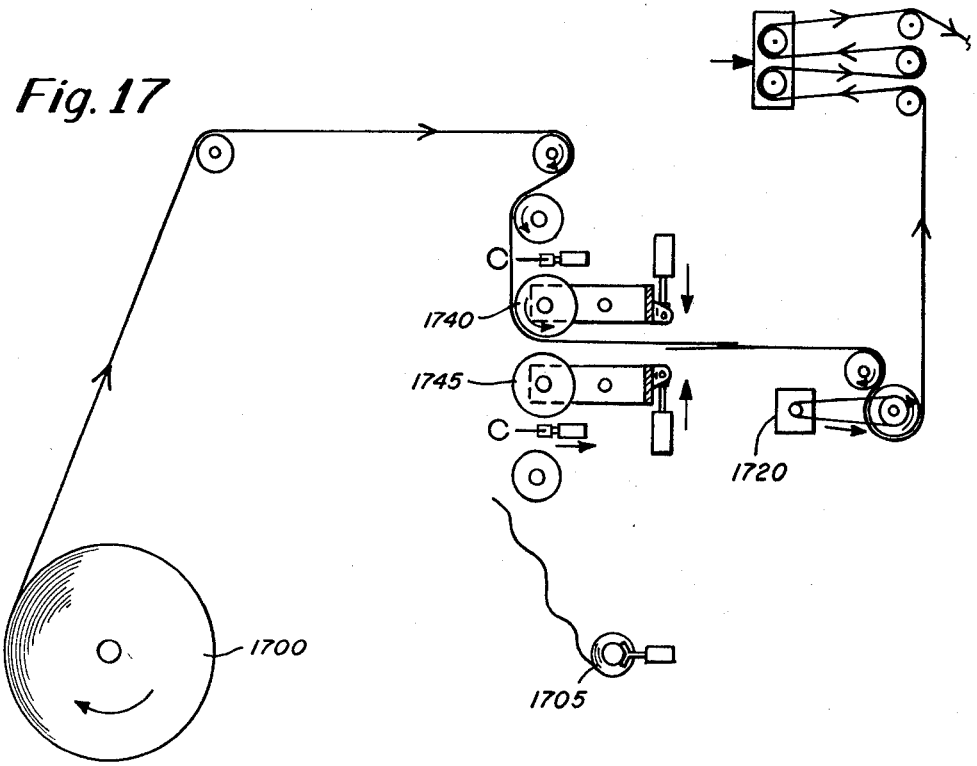

As shown in FIG. 16, during the actual splicing operation, the splicing system brakes the expired running roll, 1605, approximately to a stop and actuates the pneumatic cylinders 1650, 1651 controlling nip rollers 1640 and 1645, causing nip rollers 1640 and 1645 to press the prepared edge of the ready roll onto the trailing edge of the expired roll. In FIG. 16 both rollers are shown actuated, however, either one or both may actually be operated to perform the splicing mechanism. As previously described in accordance with the invention, the amount of slack introduced in the system may be accurately adjusted in order to allow various types of splicing operations to take place. After nip rollers 1640 and 1645 have sealed a leading edge of the ready roll to the expired roll, knife 1623 in knife carriage 1658 severs the end of expired roll 1605.

Finally, (FIG. 17) system vacuum and compressed air are released, in turn releasing nip rollers 1740 and 1745 and allowing the detent roller to retract and permit upper nip roller 1740 to rotate freely. Accelerator drive 1720 then begins to accelerate the newly spliced web material to operating speed.

Although only one illustrative embodiment of the present invention has been shown herein, other modifications and changes within the spirit and scope of the invention will be apparent to those skilled in the art, which modifications and changes are intended to covered by the claims herein.

What is claimed is:

1. In web splicing apparatus having a ready roll of web material and an expiring roll of web material, a pair of resilient nip rollers operable to splice the leading edge of web material from said ready roll to the trailing edge of web material from said expiring roll, an idler roller to guide said leading edge to one of said nip rollers, and means operable during splice preparation and a splicing operation for holding and trimming said leading edge adapted to become engaged with either of said nip rollers, the improvement comprising:

means for positioning said one nip roller in a splice preparation position and for holding said one nip roller in a splicing position rotated from said splice preparation position, means located between said idler roller and said one nip roller, said means being operable during splice preparation for drawing a slack loop of web material of precise, predetermined length between said idler roller and said one nip roller so that sad one nip roller can be rotated to said splicing position and during a splicing operation there is substantially no slack in said web material between said idler roller and said one nip roller.

2. In web splicing apparatus, the improvement according to claim 1 wherein said drawing means comprises a movable carriage having a slot therein through which said web material passes and means operable for moving said carriage in a direction transverse to said web movement.

3. In web splicing apparatus, the improvement according to claim 2 wherein said drawing means further comprises adjustable limit means for limiting the transverse movement of said carriage to a precise distance.

4. In web splicing apparatus, the improvement according to claim 3 wherein said drawing means further comprises a web severing knife and means for operating said knife to sever the web from said expiring roll of web material after a splice has been made.

5. In web splicing apparatus, the improvement according to claim 1 further comprising a trimming blade for trimming the leading edge of said ready roll during splice preparation, and means operable to position said trimming blade in front of said one nip roller during splice preparation in a position so as to allow said leading edge to be ripped off against said blade.

6. In web splicing apparatus, the improvement according to claim 5 wherein said positioning means is operable to position said blade in a position away from said one nip roller to allow further preparation of said leading edge.

7. In web splicing apparatus, the improvement according to claim 6 wherein said drawing means and said positioning means are simultaneously operated by a control means.

8. In web splicing apparatus, the improvement according to claim 7 wherein said control means is manually actuated.

9. In web splicing apparatus having a ready roll of web material and an expiring roll of web material, a pair of resilient nip rollers operable to splice the leading edge of web material from said ready roll to the trailing edge of web material from said expiring roll, and an idler roller to guide said leading edge to one of said nip rollers, the improvement comprising:

a trimming blade for trimming the leading edge of said ready roll during splice preparation, and means operable to position said trimming blade in front of either nip roller during splice preparation in a position so as to allow said leading edge to be ripped off against said blade.

10. In web splicing apparatus, the improvement according to claim 9 wherein said positioning means is operable to position said blade in a rest position away from said one nip roller to allow further preparation of said leading edge.

11. In web splicing apparatus, the improvement according to claim 10 further comprising a blade guard and means for positioning said guard over said blade to prevent injury to persons operating said splicing apparatus when said blade is in said rest position.

12. In web splicing apparatus, the improvement according to claim 11 further comprising means for moving said guard to expose said blade when said blade is in front of said one nip roller.

13. In web splicing apparatus, the improvement according to claim 12 wherein said positioning means comprises a cantilever arm attached to said splicing machine, said blade being attached to the end of said arm and cam means for moving said arm.

14. Web splicing apparatus comprising a ready roll of web material;

an expiring roll of web material a pair of nip rollers operable to splice the leading edge of web material from said ready roll to the trailing edge of web material from said expiring roll;

an idler roller to guide said leading edge to one of said nip rollers;

means operable during splice preparation and a splicing operation for holding said leading edge on said one nip roller;

means for positioning said one of said nip rollers in a splice preparation and for positioning said one nip roller in a splicing position rotated from said splice preparation position;

a movable carriage located between said idler roller and said one nip roller and having a slot therein through which said web material passes and means operable during splice preparation for moving said carriage in a direction transverse to said web movement for drawing a slack loop of web material of precise, predetermined length between said idler roller and said one nip roller so that said one nip roller can be rotated to said splicing position and during a splicing operation there is substantially no slack in said web material between said idler roller and said one nip roller;

a trimming blade for trimming the leading edge of said ready roll during splice preparation; and means operable to position said trimming blade in front of either nip roller during splice preparation in a position so as to allow said leading edge to be ripped off against said blade.

15. Web splicing apparatus according to claim 14 wherein said moving means further comprises adjustable limit means for limiting the transverse movement of said carriage to a precise distance.

16. Web splicing apparatus according to claim 15 wherein said positioning means is operable to position said blade in a position away from said one nip roller to allow further preparation of said leading edge.

17. Web splicing apparatus according to claim 16 wherein said moving means and said positioning means are simultaneously operated by a control means.

18. Web splicing apparatus according to claim 14 further comprising detent means for locking said one nip roller in splice preparation position and in splicing position.

19. Web splicing apparatus according to claim 18 wherein said detent means is automatically released by said splicing apparatus after a splice has been completed.

20. Web splicing apparatus comprising a ready roll of web material;

an expiring roll of web material;

a pair of resilient nip rollers operable to splice the leading edge of web material from said ready roll to the trailing edge of web material from said expiring roll;

a first idler roller to guide said leading edge to one of said nip rollers;

a second idler roller to guide said trailing edge from the other of said nip rollers;

means for holding said one nip roller in a splice preparation position and for holding said one nip roller in a splicing position rotated from said splice preparation position;

a first movable carriage located between said first idler roller and said one nip roller and having a slot therein through which said web material passes;

means operable during splice preparation for moving said first movable carriage in a direction transverse to said web movement for drawing a slack loop of web material of precise, predetermined length between said first idler roller and said one nip roller so that when said one nip roller is rotated from said splice preparation position to said splicing position and during a splicing operation there will be substantially no slack in said web material between said first idler roller and said one nip roller;

a second movable carriage located between said second idler roller and said other nip roller and having a slot therein through which web material passes;

a web severing knife located in said second movable carriage;

means for operating said knife to sever the web from said expiring roll of said web material after a splice has been made;

a trimming blade for trimming the leading edge of said ready roll during splice preparation; and means operable to position said trimming blade in front of either nip roller during splice preparation in a position so as to allow leading edge to be ripped off against said blade.

21. Web splicing apparatus according to claim 20 wherein said moving means further comprises adjustable limit means for limiting the transverse movement of said first movable carriage to a precise distance.

22. Web apparatus according to claim 21 wherein said positioning means comprises a pair of cantilever arms each of said arms being connected to one end of said trimming blade.

23. Web splicing apparatus according to claim 22 further comprising a blade guard connected to each of said cantilever arms;

a cam; and cam follower means for moving said trimming blade and said blade guard to expose said trimming blade when said blade is in front of said one nip roller.

24. Web splicing apparatus according to claim 23 further comprising a knife guard and wherein said web severing knife is located on one side of said web material and said knife guard is located on the other side of said web material so that, upon actuation, said knife passes through said material into said knife guard.

25. Web splicing apparatus according to claim 24 wherein said first movable carriage includes a web severing knife.

26. Web splicing apparatus according to claim 25 further comprising means for holding said other nip roller in a splice preparation position and for holding said other nip roller in a splicing position rotated from said splice preparation position; and means operable during splice preparation for moving said second movable carriage in a direction transverse to said web movement for drawing a slack loop of web material of precise, predetermined length between said other idler roller and said other nip roller so that when said other nip roller is rotated from said splice preparation position to said splicing position and during a splicing operation there will be substantially no slack in said web material between said second idler roller and said other nip roller.

* * * * *